US012507733B2

(12) United States Patent
Bouchuiguir et al.

(10) Patent No.: US 12,507,733 B2
(45) Date of Patent: Dec. 30, 2025

(54) AEROSOL GENERATION DEVICE

(71) Applicant: JT International S.A., Geneva (CH)

(72) Inventors: Layth Sliman Bouchuiguir, Bellevue (CH); Marko Plevnik, London (GB); Norihiko Inoue, London (GB)

(73) Assignee: JT International SA (CH)

( * ) Notice: Subject to any disclaimer, the term of this patent is extended or adjusted under 35 U.S.C. 154(b) by 466 days.

(21) Appl. No.: 17/631,657

(22) PCT Filed: Aug. 7, 2020

(86) PCT No.: PCT/EP2020/072306
§ 371 (c)(1),
(2) Date: Jan. 31, 2022

(87) PCT Pub. No.: WO2021/023879
PCT Pub. Date: Feb. 11, 2021

(65) Prior Publication Data

US 2022/0273036 A1 Sep. 1, 2022

(30) Foreign Application Priority Data

Aug. 8, 2019 (EP) ..... 19190866

(51) Int. Cl.
*A24F 40/46* (2020.01)
*A24F 40/50* (2020.01)

(52) U.S. Cl.
CPC ..... *A24F 40/46* (2020.01); *A24F 40/50* (2020.01)

(58) Field of Classification Search
None
See application file for complete search history.

(56) References Cited

U.S. PATENT DOCUMENTS

| | | | | |
|---|---|---|---|---|
| 10,058,122 | B2 * | 8/2018 | Steingraber | A24F 40/60 |
| 10,342,263 | B2 | 7/2019 | Memari et al. | |
| 11,316,213 | B2 * | 4/2022 | Gratton | A24F 40/40 |
| 2007/0045288 | A1 * | 3/2007 | Nelson | A61M 11/041 219/533 |
| 2017/0105448 | A1 * | 4/2017 | Scarpulla | B65D 41/20 |
| 2017/0181471 | A1 * | 6/2017 | Phillips | A24F 40/70 |
| 2017/0258142 | A1 | 9/2017 | Hatton et al. | |

(Continued)

FOREIGN PATENT DOCUMENTS

| | | |
|---|---|---|
| CN | 107713019 A | 2/2018 |
| CN | 304597578 S | 4/2018 |

(Continued)

OTHER PUBLICATIONS

CN_109480337 English Translation (Year: 2019).*

(Continued)

*Primary Examiner* — Manley L Cummins, IV
(74) *Attorney, Agent, or Firm* — Lerner David LLP

(57) ABSTRACT

An elongate aerosol generation device having a housing includes: a top end at which an aerosol is provided; a bottom end which is opposed to the top end; and four sides between the bottom end and the top end in a substantially quadrilateral arrangement of two larger opposing sides and two smaller opposing sides. The bottom end is adapted such that the device can stand on the bottom end, and the four sides are smoothly curved in a direction from the bottom end to the top end.

8 Claims, 3 Drawing Sheets

(56) References Cited

U.S. PATENT DOCUMENTS

| | | | | |
|---|---|---|---|---|
| 2019/0166914 | A1* | 6/2019 | Qiu | A24F 40/40 |
| 2019/0364957 | A1* | 12/2019 | Fu | A61M 11/042 |
| 2020/0008478 | A1* | 1/2020 | Ouyang | H05B 3/06 |

FOREIGN PATENT DOCUMENTS

| | | | | | |
|---|---|---|---|---|---|
| CN | 109480337 | A | * | 3/2019 | A24F 47/008 |
| CN | 208783785 | U | | 4/2019 | |
| CN | 208875414 | U | * | 5/2019 | |
| CN | 110313635 | A | * | 10/2019 | A24F 47/008 |
| CN | 209694057 | U | * | 11/2019 | |
| JP | 2019515704 | A | | 6/2019 | |
| WO | 2009068877 | A1 | | 6/2009 | |
| WO | WO-2012040512 | A2 | * | 3/2012 | A61L 9/032 |
| WO | 2017163044 | A1 | | 9/2017 | |
| WO | WO-2019047758 | A1 | * | 3/2019 | A24F 40/50 |
| WO | 2019081900 | A1 | | 5/2019 | |
| WO | WO-2019080745 | A1 | * | 5/2019 | A24F 40/60 |
| WO | WO-2019186149 | A1 | * | 10/2019 | A61M 11/042 |
| WO | WO-2021170832 | A1 | * | 9/2021 | A24F 40/70 |

OTHER PUBLICATIONS

WO_2019080745 English Translation (Year: 2019).*
WO_2019047758 English Translation (Year: 2019).*
CN_208875414 English Translation (Year: 2019).*
CN_209694057 English Translation (Year: 2019).*
CN_110313635 English Translation (Year: 2019).*
International Search Report for PCTEP2020072306 Dated Nov. 9, 2020, 3 pgs.

* cited by examiner

AEROSOL GENERATION DEVICE

CROSS-REFERENCE TO RELATED APPLICATIONS

The present application is a national phase entry under 35 U.S.C. § 371 of International Application No. PCT/EP2020/072306, filed Aug. 7, 2020, published in English, which claims priority to European Application No. 19190866.4 filed Aug. 8, 2019, the disclosures of which are incorporated herein by reference.

FIELD OF THE DISCLOSURE

The present disclosure relates to an aerosol generation device and to a method for manufacturing such a device. The disclosure is particularly applicable to a portable aerosol generation device, which may be self-contained and low temperature. Such devices may heat, rather than burn, tobacco or other suitable aerosol substrate materials by conduction, convection, and/or radiation, to generate an aerosol for inhalation.

BACKGROUND TO THE DISCLOSURE

The popularity and use of reduced-risk or modified-risk devices (also known as vaporisers) has grown rapidly in the past few years as an aid to assist habitual smokers wishing to quit smoking traditional tobacco products such as cigarettes, cigars, cigarillos, and rolling tobacco. Various devices and systems are available that heat or warm aerosolisable substances as opposed to burning tobacco in conventional tobacco products.

A commonly available reduced-risk or modified-risk device is the heated substrate aerosol generation device or heat-not-burn device. Devices of this type generate an aerosol or vapour by heating an aerosol substrate that typically comprises moist leaf tobacco or other suitable aerosolisable material to a temperature typically in the range 150° C. to 300° C. Heating an aerosol substrate, but not combusting or burning it, releases an aerosol that comprises the components sought by the user but not the toxic and carcinogenic by-products of combustion and burning. Furthermore, the aerosol produced by heating the tobacco or other aerosolisable material does not typically comprise the burnt or bitter taste resulting from combustion and burning that can be unpleasant for the user and so the substrate does not therefore require the sugars and other additives that are typically added to such materials to make the smoke and/or vapour more palatable for the user.

Such devices are typically elongate so that they can be easily held by hand, and the aerosol is typically provided at one end of the device, for example at a mouthpiece. Some devices do not have an integral mouthpiece and instead the user separately provides a disposable mouthpiece together with the aerosol substrate, for example in the general form of a cigarette. With such devices, it is common for the user to stand the device on a bottom end opposed to a top end which either includes an integral mouthpiece or is adapted to hold a disposable mouthpiece. One reason for this is in order to keep the mouthpiece clean while waiting for the aerosol substrate to heat up.

In many elongate aerosol generation devices, this is an unstable position that is easily knocked over or otherwise toppled, potentially leading to damage to the device. As a result, it is desirable to provide an elongate aerosol generation device that is less likely to topple or less susceptible to damage when toppled.

SUMMARY OF THE DISCLOSURE

According to a first aspect of the disclosure, there is provided an elongate aerosol generation device having a housing comprising: a top end at which an aerosol is provided; a bottom end which is opposed to the top end; and four sides between the bottom end and the top end in a substantially quadrilateral arrangement of two larger opposing sides and two smaller opposing sides. The bottom end is adapted such that the device can stand on the bottom end, and the four sides are smoothly curved in a direction from the bottom end to the top end.

Optionally, the bottom end comprises a flat surface or a recessed surface.

Optionally, each adjacent pair of the four sides is smoothly connected by a respective curved connection portion, and the four sides are smoothly curved around a longitudinal axis from the bottom end to the top end.

Optionally, the bottom end is smoothly connected to each of the four sides by a respective curved connection portion.

Optionally, the top end is smoothly connected to each of the four sides by a respective curved connection portion, and the top end is smoothly curved in a direction from one to the other of each pair of opposing sides.

Optionally, the top end comprises a sliding lid for opening and closing access to the aerosol generation device, the slider being arranged to slide along a part of the smooth curve of the top end between the two smaller opposing sides.

Optionally, a curvature of each of the four sides and the top end is lower than a curvature of the connection portions.

Optionally, each of the connection portions is curved along the length of the connection according to the parallel curvature of an adjacent side.

Optionally, the aerosol generation device further comprises a heater sub-assembly comprising a heater and a heating chamber, the heater is arranged in the heater sub-assembly to supply heat to or in the heating chamber, and the heater sub-assembly is suspended within the housing.

Optionally, the sliding lid is for opening and closing access to the heating chamber.

Optionally, the aerosol generation device further comprises a power-and-control sub-assembly comprising an electrical power source and control circuitry configured to control the supply of electrical power from the electrical power source to a heater, and the power-and-control sub-assembly is suspended within the housing.

Optionally, the heater sub-assembly and the power-and-control sub-assembly are suspended within the housing using a mounting cap attached to the access sub-assembly.

DETAILED DESCRIPTION

Embodiments use two different approaches in addressing the above-mentioned problem. Firstly, an external surface of the device is adapted to smooth out any impact force associated with the device falling over. Secondly, the most fragile internal components of the device are arranged such that they are less affected by the impact force.

More specifically, embodiments have a rounded pebble-like shape with smooth curving sides. As a result, when the device topples from standing on a bottom end, the device rolls instead of experiencing an instantaneous impact.

Additionally, embodiments have an internal frame which suspends a fragile electrical power source or a heater away from an external housing of the device. As a result, the device can deform in order to absorb an impact, or transmit the energy of the impact within the frame, without affecting the electrical power source or heater.

Within this specification, the opposing concepts of smoothness and corners/edges are defined by their purpose. More specifically, an edge or corner is a surface discontinuity that can interrupt rolling of the aerosol generation device or act as a pivot for the device to topple rather than rolling. For example, the perimeter of a depression into an otherwise roll-supporting surface of an object is not an edge. One example of such a depression shown in the figures is an etched logo that would not affect rolling.

Figure 1:
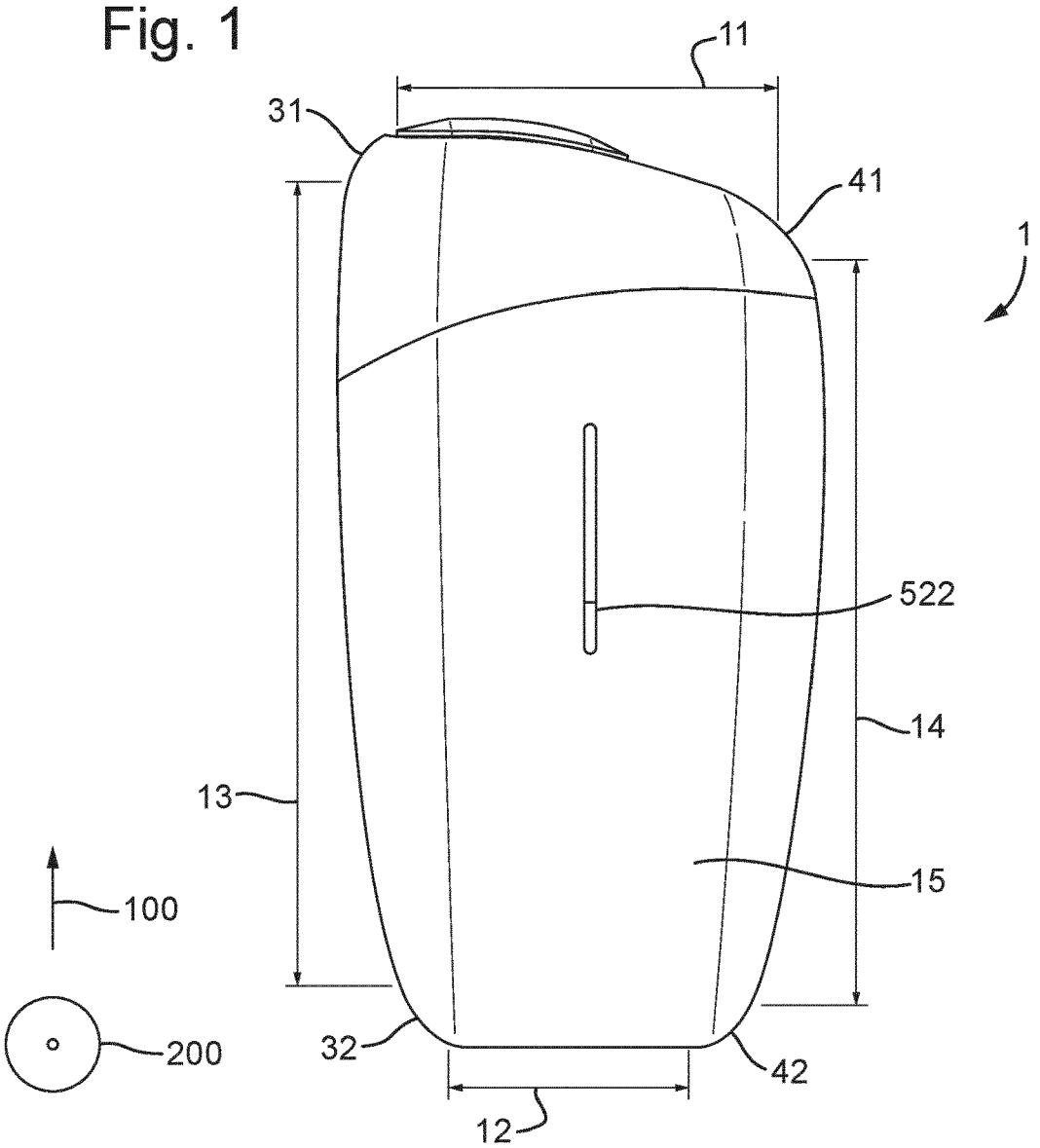
FIG. 1 is a schematic view of an aerosol generation device from a front direction.
Figure 2:
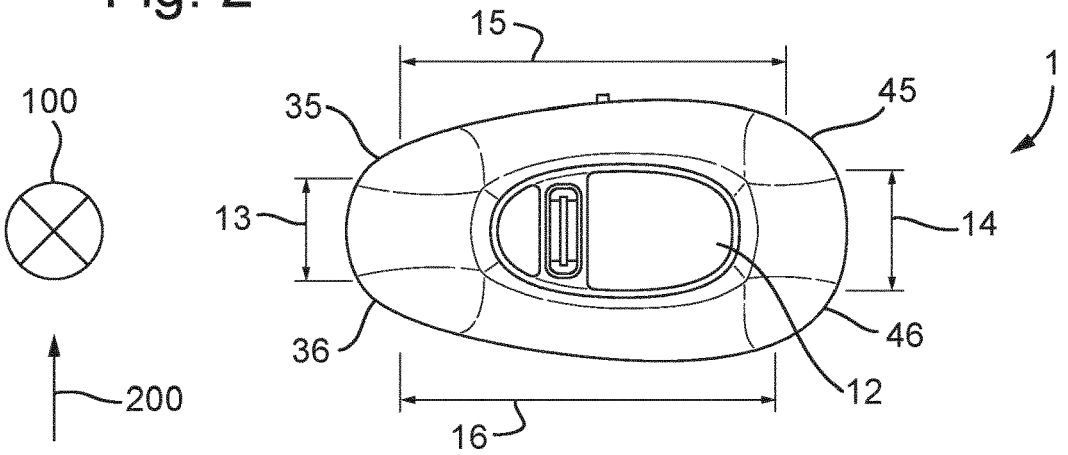
FIG. 2 is a schematic view of the aerosol generation device from below.
Figure 3:
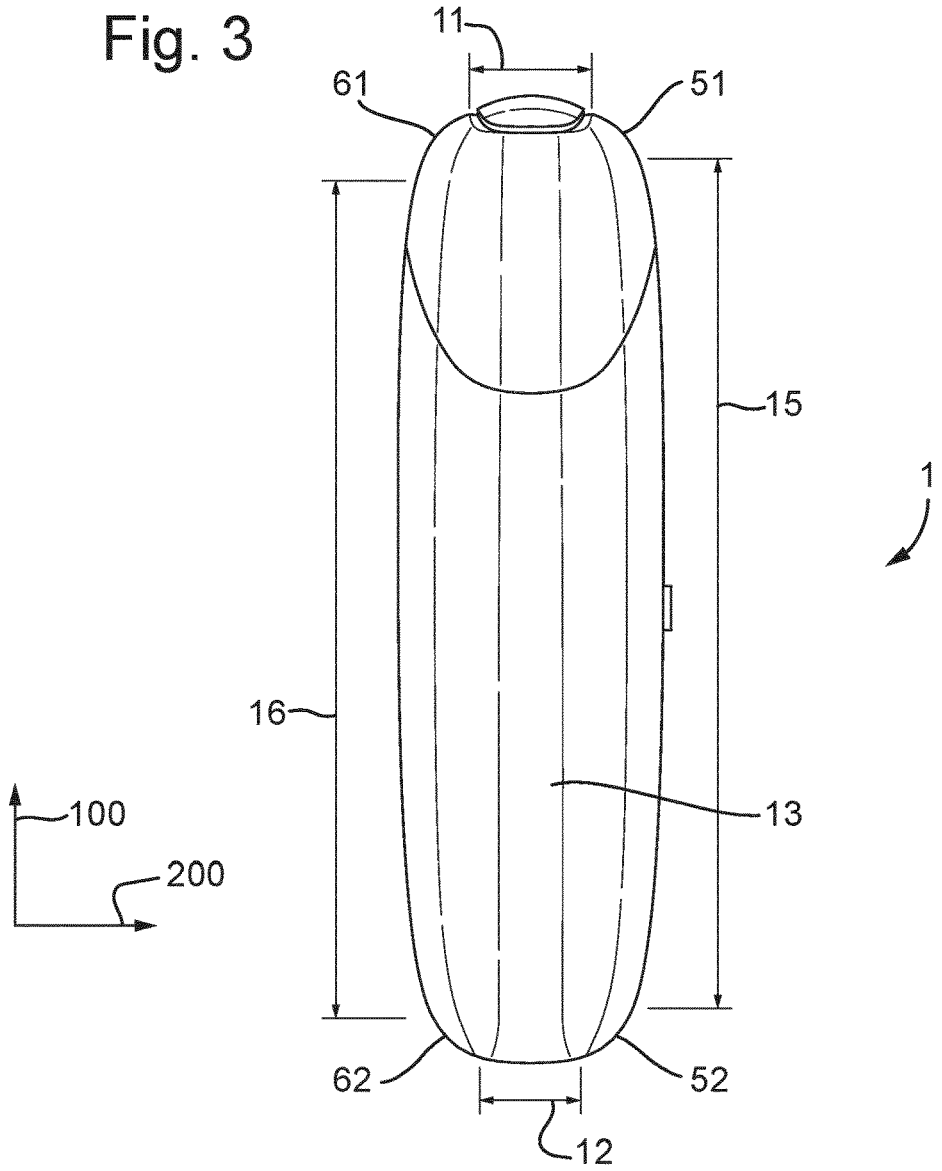
FIG. 3 is a schematic view of the aerosol generation device from a side direction.
Figure 4:
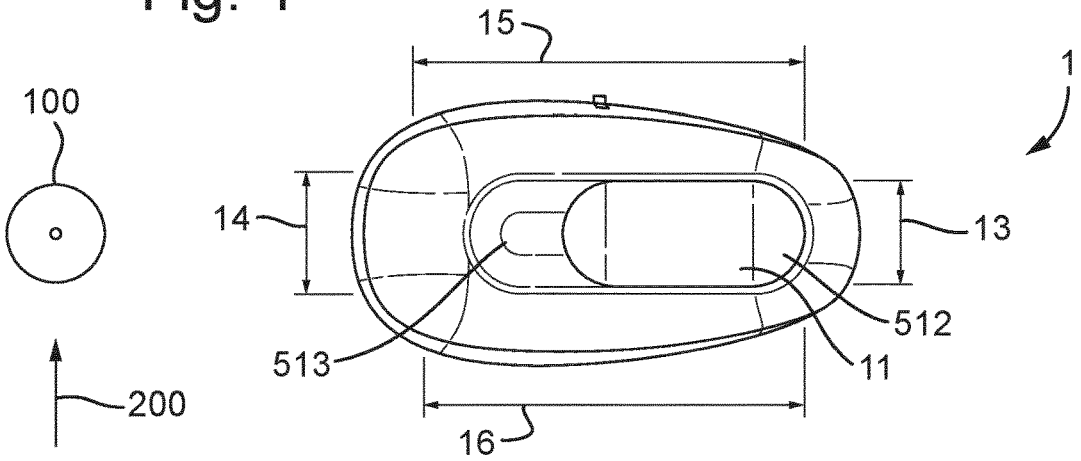
FIG. 4 is a schematic view of the aerosol generation device from above.

FIGS. 1 to 4 schematically illustrate views of an embodiment of an aerosol generation device 1 having a pebble-like external shape. In each figure the axes 100 and 200 illustrate the orientation, where a dot in a circle indicates the axis pointing out of the page, and a cross in a circle indicates the axis pointing into the page. FIG. 1 shows a front-on view, FIG. 2 shows a view from below, FIG. 3 shows a side-on view and FIG. 4 shows a view from above. Various features are only visible in some of these views but, to avoid repetition, the following description refers to the four figures together and explicitly indicates one of the figures where this is useful.

The aerosol generation device 1 comprises a top end 11, a bottom end 12 and four sides 13, 14, 15 and 16.

The top end 11 is where an aerosol is provided through an access means, and is smoothly curved between pairs of opposing sides. In this embodiment, the access means does not have an integral mouthpiece, but has a sliding lid 512 to provide access to an internal heating chamber. As can be seen most clearly in FIG. 4, the sliding lid 512 is arranged to slide within a slot 513 along a part of the smooth curve between two opposing smaller sides 13, 14. In an alternative, the slot 513 could be arranged between two opposing larger sides 15, 16. In other embodiments, the access means could alternatively have a cap removably arranged across an opening. The cap could be entirely separable or could be attached to the device 1. In use, a cigarette-like disposable product is inserted into the heating chamber such that an aerosol substrate is heated in the heating chamber and a mouthpiece of the disposable product extends out of the aerosol generation device.

The bottom end 12 is opposed to the top end and is adapted so that the aerosol generation device 1 can stand on the bottom end 12. In this embodiment, the bottom end 12 comprises a flat surface. However, any surface capable of supporting the device in a standing position can be used for the bottom end 12. For example, the bottom end 12 may instead have a recessed surface where the device 1 stands on a rim of the bottom end 12. Alternatively, the bottom end 12 could have two or more individual foot protrusions.

Two of the sides 13, 14 are substantially smaller than the other two sides 15, 16, and the sides form an approximately rectangular arrangement with two larger opposing sides and two smaller opposing sides. However, as can be seen particularly in FIGS. 2 and 4, the sides are all different and as a result do not directly face each other in a precisely rectangular arrangement, and "opposing" should be interpreted accordingly as a general indication of layout rather than a strict definition. More generally the four sides are arranged in a substantially quadrilateral arrangement. Additionally, as can be seen in FIG. 1, the sides can be arranged such that the widths between the opposing sides vary. For example, in the embodiment of FIG. 1, the aerosol generation device 1 becomes wider from the front view at the top end 11 than at the bottom end 12.

Each of the sides 13, 14, 15 and 16 has a substantially smoothly curved external surface in a direction between the bottom end and the top end, i.e. along any vertical path as the device 1 stands on the bottom end. This means that the device 1 can roll smoothly in any direction away from standing on the bottom end 12. An exception to the substantially smooth curve is the button 522 (discussed later) which protrudes from the front side 15.

In this embodiment, the sides 13, 14, 15 and 16 are also substantially smoothly curved around a central longitudinal axis from the bottom end 12 to the top end 11, to help the aerosol generation device 1 to roll without damage when already lying on one of the sides. However, such sideways rolling may be undesirable, and the sides may be flat in a direction perpendicular to the direction from the bottom end to the top end, so that the aerosol generation device 1 may more easily be placed in a stable secure position.

In this embodiment, the sides 13, 14, 15, 16 are smoothly connected to the top end 11 and bottom end 12 by curved connection portions 31, 32, 41, 42, 51, 52, 61 and 62, and adjacent sides are smoothly connected to each other by curved connection portions 35, 36, 45, 46. The connection portions are regions of higher curvature than the sides 13, 14, 15, 16 and the top end 11, although they have a sufficiently high radius of curvature not to inhibit rolling of the device 1. More specifically, the minimum radius of curvature of the connection portions is not less than 10% of the length of the aerosol generation device 1 between the bottom end 12 and the top end 11. To provide a particularly smooth rolling surface, in this embodiment, each of the connection portions is curved along the length of the connection in parallel with the curvature of an adjacent side.

The connection portions 31, 41, 51, 61 with the top end 11 and the connection portions 32, 42, 52, 62 with the bottom end 12 help the aerosol generation device 1 to roll without damage when falling from a position standing on the bottom end 12.

However, the connection portions 32, 42, 52, 62 with the bottom end 12 can decrease the stability of the position standing on the bottom end 12. Therefore, in some embodiments, the connection portions 32, 42, 52 and 62 may be replaced with an edge connection between the bottom end 12 and the sides in order to increasing standing stability.

Additionally, in some embodiments, it may be desirable to reduce the risk of damage while also preventing the device from rolling onto the top end 11, for example in order to keep a mouthpiece clean. In such embodiments, the connection portions 31, 41, 51 and 61 may be replaced with an edge connection between the top end 11 and the sides. Additionally, in such embodiments, it is not necessary for the top end 11 to be smoothly curved.

The connection portions 35, 36, 45, 46 between the sides provide a separate benefit of helping the aerosol generation device 1 to roll without damage when already lying on one of the sides. However, such sideways rolling may be undesirable, and the connection portions 35, 36, 45, 46 may be replaced with edge connections so that the aerosol generation device 1 may more easily be placed in a stable secure position.

Overall, there are three groups of connections: 31, 41, 51, 61; 32, 42, 52, 62; and 35, 36, 45, 46, each group of which have different advantages and can be independently omitted in embodiments.

Figure 5:
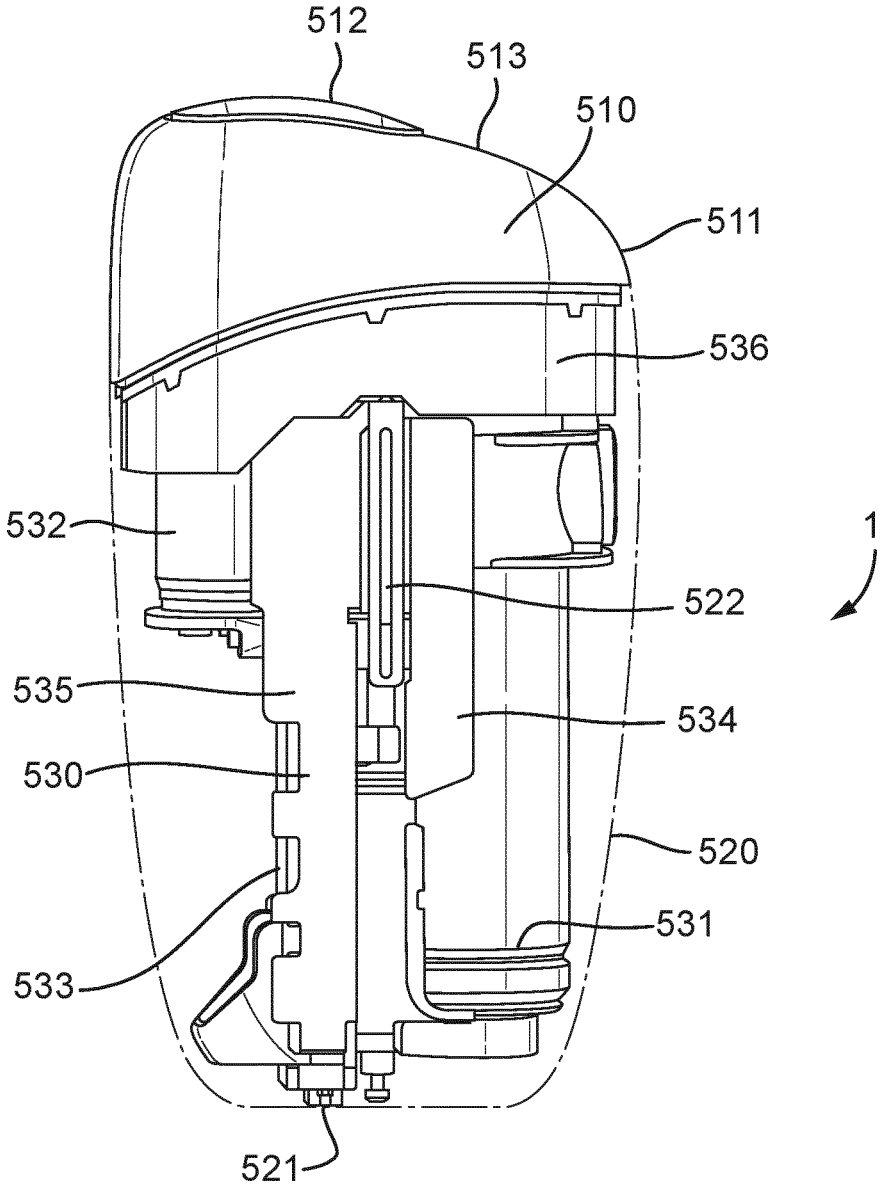
FIG. 5 is a schematic view of internal components of the aerosol generation device from the front direction.

FIG. 5 is a schematic illustration of functional aspects of the aerosol generation device 1, and illustrates internal components by representing a part of the housing as "transparent" (illustrated using dashed lines).

Referring to FIG. 5, the outer housing of the aerosol generation device 1 is provided by an access sub-assembly 510 and a housing sub-assembly 520.

The access sub-assembly 510 incorporates an access housing 511, the slider lid 512 and the slot 513.

The housing sub-assembly 520 incorporates an electrical connection port 521 and an interface 522 including one or more indicators and buttons for controlling the aerosol generation device 1.

Due to the "transparency" of the housing sub-assembly 520 in FIG. 5 an internal sub-assembly 530 is shown. The housing sub-assembly 520 may or may not actually be transparent, but is illustrated as such to show how the internal sub-assembly 530 is positioned within the housing sub-assembly 520.

The internal sub-assembly 530 includes an electrical power source 531, such as a battery, and a heater sub-assembly 532 comprising a heater and a heating chamber. The heater is arranged in the heater sub-assembly to supply heat to or in the heating chamber. The heater may for example be a film heater wrapped around the heating chamber or a blade-type heater arranged inside the heating chamber. When the sliding lid 512 is moved to an open position, this provides access to the heating chamber and, similarly, when the sliding lid 512 is moved to a closed position, this closes access to the heating chamber.

In this embodiment, the electrical power source 531 and the heater sub-assembly 532 are both arranged in and held by the internal sub-assembly 530 such that there is space between them and an inner surface of the housing sub-assembly 520. In other words, the electrical power source 531 and the heater sub-assembly 532 are suspended within the housing. This means that the electrical power source 531 and heater sub-assembly 532 are protected from impacts and fragile components can be used for them with a reduced risk that the aerosol generation device 1 stops working if and when it falls over.

The internal sub-assembly 530 also includes control circuitry 533 which may for example be mounted on one or more PCBs, and includes an electrical power source support frame 534 and a heater sub-assembly support frame 535. The electrical power source support frame and the heater sub-assembly support frame respectively keep the heater sub-assembly 532 and the electrical power source 531 suspended away from the external housing. More generally, the electrical power source 531, the control circuitry 533, the electrical power source support frame 534, and the heater sub-assembly support frame 535 fit together to form a power-and-control sub-assembly that is suspended within the housing. The heater sub-assembly support frame 535 and electrical power source support frame 534 may, for example, comprise PA (Polyamide) and/or PEEK (Polyether ether ketone).

Additionally, in this embodiment, a mounting cap 536 is arranged to fit over an end of the aligned heater sub-assembly 532 and power-and-control sub-assembly in a longitudinal direction, and to hold the heater sub-assembly 532 and power-and-control sub-assembly. Thus the heater sub-assembly 532 and power-and-control sub-assembly are suspended by the mounting cap 536 within the housing.

In alternatives to the depicted embodiment, the electrical power source support frame 534 and the heater sub-assembly support frame 535 could be replaced with a single frame, or could be omitted entirely. Additionally, the features of suspending internal components within the housing can be omitted in embodiments where the smooth housing provides sufficient protection.

Definitions and Alternative Embodiments

It will be appreciated from the description above that many features of the described embodiment perform independent functions with independent benefits. Therefore the inclusion or omission of each of these independent features from embodiments of the invention defined in the claims can be independently chosen.

The term "heater" should be understood to mean any device for outputting thermal energy sufficient to form an aerosol from the aerosol substrate. The transfer of heat energy from the heater to the aerosol substrate may be conductive, convective, radiative or any combination of these means. As non-limiting examples, conductive heaters may directly contact and press the aerosol substrate, or they may contact a separate component such as the heating chamber which itself causes heating of the aerosol substrate by conduction, convection, and/or radiation.

Heaters may be electrically powered, powered by combustion, or by any other suitable means. Electrically powered heaters may include resistive track elements (optionally including insulating packaging), induction heating systems (e.g. including an electromagnet and high frequency oscillator), etc. The heater 54 may be arranged around the outside of the aerosol substrate, it may penetrate part way or fully into the aerosol substrate, or any combination of these. For example, an aerosol generation device may have a blade-type heater that extends into an aerosol substrate in the heating chamber.

The term "temperature sensor" is used to describe an element which is capable of determining an absolute or relative temperature of a part of the aerosol generation device 1. This can include thermocouples, thermopiles, thermistors and the like. The temperature sensor may be provided as part of another component, or it may be a separate component. In some examples, more than one temperature sensor may be provided, for example to monitor heating of different parts of the aerosol generation device 1, e.g. to determine thermal profiles. Alternatively, in some examples, no temperature sensor is included; for example, this would be possible where thermal profiles have already been reliably established and a temperature can be assumed based on operation of the heater.

The control circuitry 533 in the figures is shown as having a single user operable button to trigger the aerosol generation device 1 to turn on. This keeps the control simple and reduces the chances that a user will misuse the aerosol generation device 1 or fail to control the aerosol generation device 1 correctly. In some cases, however, the input controls available to a user may be more complex than this, for example to control the temperature, e.g. within pre-set limits, to change the flavour balance of the vapour, or to switch between power saving or quick heating modes, for example.

Aerosol substrate includes tobacco, for example in dried or cured form, in some cases with additional ingredients for flavouring or producing a smoother or otherwise more pleasurable experience. In some examples, the aerosol substrate such as tobacco may be treated with a vaporising agent. The vaporising agent may improve the generation of vapour from the aerosol substrate. The vaporising agent may include, for example, a polyol such as glycerol, or a glycol such as propylene glycol. In some cases, the aerosol substrate may contain no tobacco, or even no nicotine, but instead may contain naturally or artificially derived ingredients for flavouring, volatilisation, improving smoothness, and/or providing other pleasurable effects. The aerosol substrate may be provided as a solid or paste type material in shredded, pelletised, powdered, granulated, strip or sheet form, optionally a combination of these. Equally, the aerosol substrate may be a liquid or gel. Indeed, some examples may include both solid and liquid/gel parts.

Consequently, the aerosol generation device 1 could equally be referred to as a "heated tobacco device", a "heat-not-burn tobacco device", a "device for vaporising tobacco products", and the like, with this being interpreted as a device suitable for achieving these effects. The features disclosed herein are equally applicable to devices which are designed to vaporise any aerosol substrate.

The aerosol generation device 1 may be arranged to receive the aerosol substrate in a pre-packaged substrate carrier. The substrate carrier may broadly resemble a cigarette, having a tubular region with an aerosol substrate arranged in a suitable manner. Filters, vapour collection regions, cooling regions, and other structure may also be included in some designs. An outer layer of paper or other flexible planar material such as foil may also be provided, for example to hold the aerosol substrate in place, to further the resemblance of a cigarette, etc. The substrate carrier may fit within the heating chamber or may be longer than the heating chamber such that the sliding lid 512 remains open while the aerosol generation device 1 is provided with the substrate carrier. In such embodiments, the aerosol may be provided directly from the substrate carrier which acts as a mouthpiece for the aerosol generation device.

As used herein, the term "fluid" shall be construed as generically describing non-solid materials of the type that are capable of flowing, including, but not limited to, liquids, pastes, gels, powders and the like. "Fluidized materials" shall be construed accordingly as materials which are inherently, or have been modified to behave as, fluids. Fluidization may include, but is not limited to, powdering, dissolving in a solvent, gelling, thickening, thinning and the like.

As used herein, the term "volatile" means a substance capable of readily changing from the solid or liquid state to the gaseous state. As a non-limiting example, a volatile substance may be one which has a boiling or sublimation temperature close to room temperature at ambient pressure. Accordingly "volatilize" or "volatilise" shall be construed as meaning to render (a material) volatile and/or to cause to evaporate or disperse in vapour.

As used herein, the term "vapour" (or "vapor") means: (i) the form into which liquids are naturally converted by the action of a sufficient degree of heat; or (ii) particles of liquid/moisture that are suspended in the atmosphere and visible as clouds of steam/smoke; or (iii) a fluid that fills a space like a gas but, being below its critical temperature, can be liquefied by pressure alone.

Consistently with this definition the term "vaporise" (or "vaporize") means: (i) to change, or cause the change into vapour; and (ii) where the particles change physical state (i.e. from liquid or solid into the gaseous state).

As used herein, the term "atomise" (or "atomize") shall mean: (i) to turn (a substance, especially a liquid) into very small particles or droplets; and (ii) where the particles remain in the same physical state (liquid or solid) as they were prior to atomization.

As used herein, the term "aerosol" shall mean a system of particles dispersed in the air or in a gas, such as mist, fog, or smoke. Accordingly the term "aerosolise" (or "aerosolize") means to make into an aerosol and/or to disperse as an aerosol. Note that the meaning of aerosol/aerosolise is consistent with each of volatilise, atomise and vaporise as defined above. For the avoidance of doubt, aerosol is used to consistently describe mists or droplets comprising atomised, volatilised or vaporised particles. Aerosol also includes mists or droplets comprising any combination of atomised, volatilised or vaporised particles.

The invention claimed is:

1. An elongate aerosol generation device for vaporising tobacco products, the device having a housing comprising:

a top end at which an aerosol is configured to be provided;

a bottom end which is opposed to the top end; and four sides between the bottom end and the top end in a substantially quadrilateral arrangement of two larger opposing sides and two smaller opposing sides, an access subassembly comprising the top end; and a housing subassembly comprising the bottom end, wherein the bottom end comprises a surface configured for supporting the device in a standing position such that the device can stand on the bottom end, and the four sides are smoothly curved in a direction from the bottom end to the top end, wherein the aerosol generating device further comprises:

a heater subassembly including a heater and a heating chamber, the heater disposed within the heater subassembly to provide heat to or within the heating chamber, the heater subassembly suspended within the housing, the heater subassembly and an inner surface of the housing defining a space between the heater subassembly and the inner surface;

a power-and-control sub-assembly comprising a power source and control circuitry, the control circuitry configured to control the supply of power from the power source to the heater, the power-and-control sub-assembly and the inner surface of the housing defining a space between the power-and-control sub-assembly and the housing; and a mounting cap attached to the access subassembly, wherein the heater subassembly and the power-and-control sub-assembly are held by the mounting cap and suspended within the housing.

2. The aerosol generation device according to claim 1, wherein the surface comprises a flat surface.

3. The aerosol generation device according to claim 1, wherein the bottom end is smoothly connected to each of the four sides by a respective curved connection portion.

4. The aerosol generation device according to claim 1, wherein the top end is smoothly connected to each of the four sides by a respective curved connection portion, and the top end is smoothly curved in a direction from one to another of each pair of opposing sides.

5. The aerosol generation device according to claim 4, wherein the top end comprises a sliding lid for opening and closing access to the aerosol generation device, the sliding lid being arranged to slide along a part of a smooth curve of the top end between the two smaller opposing sides.

6. The aerosol generation device according to claim 5, further comprising:

wherein the sliding lid is for opening and closing access to the heating chamber.

7. The aerosol generation device according to claim 4, wherein a curvature of each of the four sides and the top end is lower than a curvature of the connection portions.

8. The aerosol generation device according to claim 1, wherein each of the connection portions is curved along a length of the connection portion according to a parallel curvature of an adjacent side.

* * * * *